US006097270A

United States Patent [19]

Yamanobe

[11] Patent Number: 6,097,270

[45] Date of Patent: Aug. 1, 2000

[54] COAXIAL DIELECTRIC FILTER

[75] Inventor: Yasunori Yamanobe, Chiba, Japan

[73] Assignee: Sumitomo Metal Mining Co., Ltd., Tokyo, Japan

[21] Appl. No.: 09/253,712

[22] Filed: Feb. 22, 1999

[30] Foreign Application Priority Data

Feb. 24, 1998 [JP] Japan ..... 10-058969
Feb. 24, 1998 [JP] Japan ..... 10-058970

[51] Int. Cl.[7] ..... H01P 1/20

[52] U.S. Cl. ..... 333/202; 333/206; 333/208

[58] Field of Search ..... 333/202, 206, 333/207, 208, 222

[56] References Cited

U.S. PATENT DOCUMENTS 3,939,443 2/1976 Biró et al. ..... 333/73 R
4,223,287 9/1980 Nishikawa et al. ..... 333/206
5,608,415 3/1997 Sugawara ..... 333/207

FOREIGN PATENT DOCUMENTS 2 341 210 9/1977 France .

OTHER PUBLICATIONS

JP 08 088504, Patent Abstracts of Japan, vol. 96, No. 8, Aug. 30, 1996.

*Primary Examiner*—Robert Pascal
*Assistant Examiner*—Patricia Nguyen
*Attorney, Agent, or Firm*—Armstrong, Westerman, Hattori, McLeland & Naughton

[57] ABSTRACT

A coaxial dielectric filter comprising a straight cutoff waveguide, at least two coaxial dielectric resonators disposed coaxially or substantially coaxially and at an interval in the cutoff waveguide in its lengthwise direction, a rod-like input-side antenna whose leading end stands close, or inserted, to the inside of an input-side inner conductor of the coaxial dielectric resonator disposed on the input side, and a rod-like output-side antenna whose leading end stands close, or inserted, to the inside of an output-side inner conductor of the coaxial dielectric resonator disposed on the output side. This filter is characterized in that an adjacent-side end of at least one of coaxial dielectric resonators adjacent to each other forms a slope which is inclined with respect to the cutoff waveguide in its cross section perpendicular to the lengthwise direction.

In the adjustment of distance between the coaxial dielectric resonators adjacent to each other, the distance between the coaxial dielectric resonators on their adjacent sides can be adjusted simply not only when the coaxial dielectric resonator provided with the slope is moved in the lengthwise direction of the cutoff waveguide but also when it is moved in the width direction of the cutoff waveguide.

6 Claims, 9 Drawing Sheets

COAXIAL DIELECTRIC FILTER

BACKGROUND OF THE INVENTION

1. Field of the Invention

This invention relates to a coaxial dielectric filter whose main part is constituted of at least two coaxial dielectric resonators and is used in, e.g., the regeneration of signals and extraction of clock signals in regenerative repeaters of optical communication. More particularly, this invention relates to an improvement of a coaxial dielectric filter, so improved that the locational relation in assembly component parts can be adjusted simply and also the freedom of signal-withdrawing direction can be made larger to enable miniaturization.

2. Description of the Related Art

FIG. 9 is an equivalent circuit diagram of a typical dielectric filter making use of coaxial dielectric resonators, comprising a tubular main body provided with an outer conductor (layer) and an inner conductor (layer) on its periphery and inner wall, respectively. FIG. 10 is a plan view showing the structure of a dielectric filter, in particular, a conventional coaxial dielectric filter making use of capacitors (Japanese Patent Application Laid-open No.51-130141 and No. 52-96846). In the typical coaxial dielectric filter, as shown in FIG. 9 equivalent circuit diagram, component parts such as capacitors C1, C2 and C3 (or inductors) are disposed in order to attain electrical coupling between an input-side connector and one coaxial dielectric resonator a, between both coaxial dielectric resonators a (stage-to-stage) and between the other coaxial dielectric resonator a and an output-side connector. In the conventional coaxial dielectric filter, the capacitors are formed on a substrate of alumina or the like by a technique such as thick-film printing in order to attain the desired electrical coupling, and are connected through capacitor connecting leads as shown in FIG. 10. In FIG. 10, letter symbol a denotes a coaxial dielectric resonator; b, an input-output capacitor; c, a stage-to-stage capacitor; d, a metal casing which constitutes part of a cutoff waveguide and is provided with a concave holding part d'; e, an input-side connector; f, an output-side connector; and g, a capacitor connecting lead.

Now, in dielectric filters, when it is attempted to produce a coaxial dielectric filter having a narrow passband width, it is necessary to use a capacitor having a very small capacitance. In the above manner of electrical coupling making use of a substrate of aluminum, it is structurally very difficult to materialize capacitors having a small capacitance, and hence there has been a disadvantage that coaxial dielectric filters having a narrow passband width can not be mass-produced.

Accordingly, the present applicant has already proposed a coaxial dielectric filter in which a novel manner of electrical coupling not making use of any component parts such as capacitors is employed so that its structure can be simplified (see Japanese Patent Application Laid-open No. 8-88504).

More specifically, the above coaxial dielectric filter is constituted chiefly of, as shown in FIGS. 11A to 11C, i) a straight cutoff waveguide constituted of a holding part d' provided in a metal casing d and a metal cover d" which closes the open side of the holding part d', ii) two coaxial dielectric resonators a disposed coaxially or substantially coaxially in the cutoff waveguide at a certain interval and each comprising a tubular main body al provided with an outer conductor and an inner conductor on its periphery a2 and inner wall a3, respectively, iii) a rod-like input-side antenna i whose base end is supported by an input-side connector e fastened to the input-side wall surface of the cutoff waveguide and whose leading end stands close, or inserted, to the inside of the input-side inner conductor of the coaxial dielectric resonator a disposed on the input side, and iv) a rod-like output-side antenna j whose base end is supported by an output-side connector f fastened to the output-side wall surface of the cutoff waveguide and whose leading end stands close, or inserted, to the inside of the output-side inner conductor of the coaxial dielectric resonator a disposed on the output side. Incidentally, since as shown in FIG. 11C the outer conductor and inner conductor provided on the periphery a2 and inner wall a3, respectively, of the tubular main body a1 have a common axis a', the resonators are called coaxial dielectric resonators.

In the above coaxial dielectric filter, the electrical coupling corresponding to the coupling at C1 and C3 shown in FIG. 9 are attained respectively by making the leading end of the rod-like input-side antenna i (whose base end is supported by the input-side connector) stand close, or inserted, to the inside of the input-side inner conductor of the input-side coaxial dielectric resonator a, and by making the leading end of the rod-like output-side antenna j (whose base end is supported by the output-side connector f) stand close, or inserted, to the inside of the output-side inner conductor of the output-side coaxial dielectric resonator a. Also, the amount of electrical coupling of these can be changed by changing the extent to which the rod-like input-side antenna i and output-side antenna j are made to stand close, or inserted, to the insides of the inner conductors of the input-side and output-side coaxial dielectric resonators a to change the distance or area where the inner conductors of the input-side and output-side coaxial dielectric resonators a face the antennas i and J, respectively. Hence, the amount of electrical coupling at C1 and C3 can be adjusted by changing the extent to which the rod-like input-side antenna i and output-side antenna j are made to stand close, or inserted, to the insides of the inner conductors of the input-side and output-side coaxial dielectric resonators a. Incidentally, when adjusted by making the leading ends of the antennas close to the insides of the inner conductors of the coaxial dielectric resonators, the amount of electrical coupling is smaller than when the leading ends of the antennas are inserted to the insides of the inner conductors. Its value, however, can be made larger by setting small the internal diameter of the tubular cavities of the coaxial dielectric resonators.

As for the electrical coupling corresponding to the coupling at C2 shown in FIG. 9, it can be provided by making larger the distance between open sides on the side where the input-side and output-side coaxial dielectric resonators a face each other, when they are disposed in the cutoff waveguide. The amount of this electrical coupling attenuates exponential-functionally as the distance between the input-side and output-side coaxial dielectric resonators a is made larger in the cutoff waveguide. Thus, the amount of electrical coupling C2 between the input-side and output-side coaxial dielectric resonators a can be adjusted by changing the distance between the input-side and output-side coaxial dielectric resonators a facing each other.

The coaxial dielectric filter shown in FIG. 11A has a structure wherein at least two coaxial dielectric resonators a and the rod-like input-side antenna i and output-side antenna j are disposed in the straight cutoff waveguide, and hence it has necessarily a long size. Thus, there has been room for improvement more or less when coaxial dielectric filters are made small-sized.

Accordingly, the present applicant has already proposed a coaxial dielectric filter in which a flexure (a bent portion) is provided in the cutoff waveguide so that its length can be made smaller (see Japanese Patent Application Laid-open No. 10-98305).

More specifically, this coaxial dielectric filter comprises, as shown in FIGS. 12A and 12B, a cutoff waveguide q having a flexure p and in which the input-side and output-side coaxial dielectric resonators a, the rod-like input-side antenna i and output-side antenna j and so forth as described above are disposed to constitute a filter that functions in substantially the same manner as the straight type coaxial dielectric filter shown in FIG. 11A.

According to these coaxial dielectric filters developed by the present applicant, the filters can be made to have a simple structure because of employment of novel manners of electrical coupling and the number of component parts can also be made smaller, and hence have an advantage that coaxial dielectric filters with a narrow passband can be produced simply and at a low cost.

Now, in such coaxial dielectric filters in which two coaxial dielectric resonators are incorporated, the desired characteristics can be achieved when the degree of electrical coupling is well-balanced at three points between the coaxial dielectric resonator a disposed on the input side and the input-side antenna i, between the two input-side and output-side coaxial dielectric resonators a and between the coaxial dielectric resonator a disposed on the output side and the output-side antenna J. In other words, the resultant coaxial dielectric filter changes in characteristic values if it is ill-balanced even at any one point.

When the filter is made well-balanced at the three points, a high precision is required for the adjustment between the two coaxial dielectric resonators, compared with the adjustment between the coaxial dielectric resonators and each antenna. This is because the amount of electrical coupling attenuates exponential-functionally as the distance between the coaxial dielectric resonators is made larger as stated previously, and hence the adjustment of distance between the coaxial dielectric resonators affects characteristics greatly when the degree of electrical coupling is made well-balanced, compared with the adjustment of distance between the coaxial dielectric resonators and each antenna.

Meanwhile, the coaxial dielectric resonators incorporated in these coaxial dielectric filters are each constituted chiefly of a tubular main body al having a cross-sectionally quadrangular shape in appearance and having a cross-sectionally circular shape at its cavity, formed of, e.g., a barium or titanium type oxide ceramic, and conductor layers formed of thick-film silver paste, provided on the periphery and inner wall of the tubular main body a1 (see FIG. 11C) (the conductor layer provided on the inner wall is called the inner conductor, and the conductor layer provided on the periphery is called the outer conductor), and also has a structure wherein the both ends in the lengthwise direction stand vertical and the both ends are not provided with any conductor layers so as to be made electrically open.

Individual coaxial dielectric resonators before adjustment, to be incorporated in the coaxial dielectric filter, have specific scatterings of dielectric constant or dielectric loss of dielectrics and conductor loss of the outer conductor which are caused by scatterings of conditions in the manufacture of dielectric materials (e.g., scatterings of process size, and scatterings of density which occur when molded or baked). Accordingly, before they are incorporated in the coaxial dielectric filter, the ends of coaxial dielectric resonators produced are cut individually to make pre-adjustment so that their resonant frequencies are uniformed, thus, as a matter of course, the individual coaxial dielectric resonators have non-uniform length depending on the amount of cutting.

Accordingly, when the coaxial dielectric resonators are disposed in the cutoff waveguide, the adjustment of distance between them can be made with difficulty because of such non-uniform length of the individual coaxial dielectric resonators, and also even any slight deviation in the setting of the distance between the coaxial dielectric resonators may make it impossible to obtain coaxial dielectric filters having the intended characteristic values. Such a problem has been unsettled.

Moreover, in the case of the coaxial dielectric resonator shown in FIG. 12A, having a flexure p in the cutoff waveguide q, there is no problem so much when the flexure is set at an obtuse angle. However, as the angle set at the flexure p is made smaller, it becomes difficult to dispose face-to-face the two coaxial dielectric resonators a at their ends on the side adjacent to each other (i.e., adjacent-side ends), and hence the electrical coupling between the resonators tend to become weak, making it difficult to attain the electrical coupling in an extreme case. Such a problem also has been unsettled.

SUMMARY OF THE INVENTION

The present invention was made taking note of such problems. Accordingly, an object of the present invention is to provide a coaxial dielectric filter that enables easy adjustment of the locational relation in assembly component parts.

Another object of the present invention is to provide a coaxial dielectric filter that can make the freedom of signal-withdrawing direction large to enable miniaturization of the filter.

Still another object of the present invention is to provide a coaxial dielectric filter that can achieve the desired characteristics even when, in the coaxial dielectric filter having a flexure in the cutoff waveguide, the angle is set small at the flexure.

To achieve the above objects, the coaxial dielectric filter according to a first embodiment of the present invention comprises a straight cutoff waveguide, at least two coaxial dielectric resonators disposed coaxially or substantially coaxially and at an interval in the cutoff waveguide in its lengthwise direction, a rod-like input-side antenna whose leading end stands close, or inserted, to the inside of an input-side inner conductor of the coaxial dielectric resonator disposed on the input side, and a rod-like output-side antenna whose leading end stands close, or inserted, to the inside of an output-side inner conductor of the coaxial dielectric resonator disposed on the output side, wherein;

an adjacent-side end of at least one of coaxial dielectric resonators adjacent to each other forms a slope which is inclined with respect to the cutoff waveguide in its cross section perpendicular to its lengthwise direction.

According to a second embodiment of the present invention, the coaxial dielectric filter comprises a cutoff waveguide having at least one flexure, at least two coaxial dielectric resonators disposed coaxially or substantially coaxially and at an interval in the cutoff waveguide on its both sides bordering at the flexure, a rod-like input-side antenna whose leading end stands close, or inserted, to the inside of an input-side inner conductor of the coaxial dielectric resonator disposed on the input side, and a rod-like output-side antenna whose leading end stands close, or inserted, to the inside of an output-side inner conductor of the coaxial dielectric resonator disposed on the output side, wherein;

adjacent-side ends of a pair of coaxial dielectric resonators adjacent to each other on the border at the flexure each form a slope which is in parallel or substantially in parallel to a flexure cross section along the line passing the middle or substantially the middle of each of the outer peripheral side and inner peripheral side at the flexure in the cutoff waveguide.

DESCRIPTION OF THE PREFERRED EMBODIMENTS

Figure 1A:
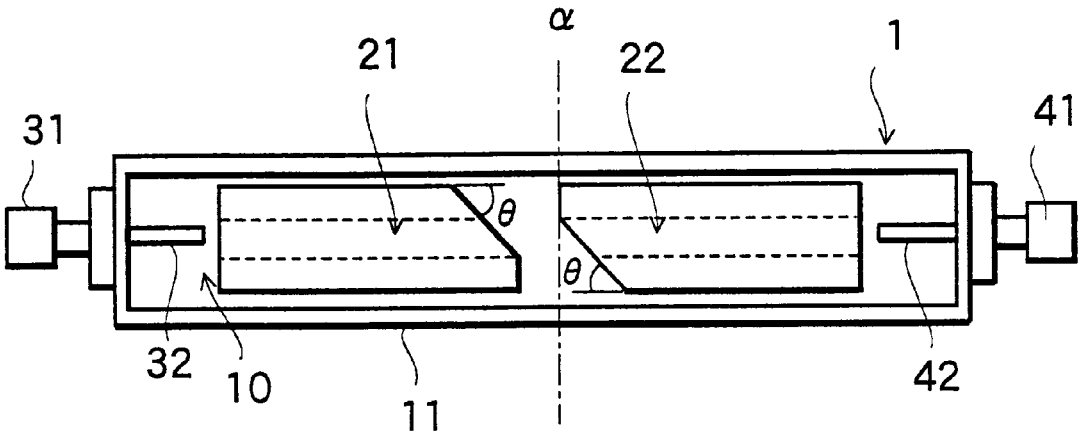
FIG. 1A is a cover-removed plan view of a coaxial dielectric filter according to the first embodiment of the present invention.

The present invention will be described below in detail.

In a first embodiment of the present invention, the coaxial dielectric filter has a straight cutoff waveguide. In this cutoff waveguide, at least two coaxial dielectric resonators are disposed coaxially or substantially coaxially and at an interval in the waveguide in its lengthwise direction. The filter also has a rod-like input-side antenna whose leading end stands close, or inserted, to the inside of an input-side inner conductor of the coaxial dielectric resonator disposed on the input side, and a rod-like output-side antenna whose leading end stands close, or inserted, to the inside of an output-side inner conductor of the coaxial dielectric resonator disposed on the output side. The coaxial dielectric filter according to the first embodiment of the present invention is characterized in that an adjacent-side end of at least one of coaxial dielectric resonators adjacent to each other forms a slope which is inclined with respect to the cutoff waveguide in its cross section perpendicular to its lengthwise direction.

According to this coaxial dielectric filter, the adjacent-side end of at least one of the coaxial dielectric resonators adjacent to each other forms a slope which is inclined with respect to the cutoff waveguide in its cross section perpendicular to its lengthwise direction. Hence, in an instance where at least two coaxial dielectric resonators are disposed in the cutoff waveguide and the distance between the coaxial dielectric resonators adjacent to each other is adjusted, the distance between the coaxial dielectric resonators on their adjacent sides can be adjusted not only when the coaxial dielectric resonator provided with the slope is moved in the lengthwise direction of the cutoff waveguide but also when it is moved in the width direction of the cutoff waveguide.

More specifically, the direction of movement of the coaxial dielectric resonator for the adjustment of the degree of electrical coupling between the coaxial dielectric resonators adjacent to each other can be a biaxial direction which includes not only the lengthwise direction of the cutoff waveguide but also its width direction. Hence, the adjustment of the degree of electrical coupling between the coaxial dielectric resonators adjacent to each other can be made simply, compared with that in conventional coaxial dielectric filters.

In a second embodiment of the present invention, the coaxial dielectric filter has a cutoff waveguide having at least one flexure. In this cutoff waveguide, at least two coaxial dielectric resonators are disposed coaxially or substantially coaxially and at an interval in the waveguide on its both sides (input side and output side) bordering at the flexure. The filter also has a rod-like input-side antenna whose leading end stands close, or inserted, to the inside of an input-side inner conductor of the coaxial dielectric resonator disposed on the input side, and a rod-like output-side antenna whose leading end stands close, or inserted, to the inside of an output-side inner conductor of the coaxial dielectric resonator disposed on the output side. The coaxial dielectric filter according to the second embodiment of the present invention is characterized in that adjacent-side ends of a pair of coaxial dielectric resonators adjacent to each other on the border at the flexure each form a slope which is in parallel or substantially in parallel to a flexure cross section along the line passing the middle or substantially the middle of each of the outer peripheral side and inner peripheral side at the flexure in the cutoff waveguide.

According to this coaxial dielectric filter, adjacent-side ends of a pair of coaxial dielectric resonators adjacent to each other on the border at the flexure each form a slope which is in parallel or substantially in parallel to the flexure cross section. Hence, in an instance where the distance between the pair of coaxial dielectric resonators adjacent to each other on the border at the flexure is adjusted, the distance between the coaxial dielectric resonators on their adjacent sides can be adjusted not only when the coaxial dielectric resonator provided with the slope is moved in the direction of resonator arrangement but also when it is moved in the width direction of the cutoff waveguide.

More specifically, the direction of movement of the coaxial dielectric resonator for the adjustment of the degree of electrical coupling between the coaxial dielectric resonators adjacent to each other on the border at the flexure can be a biaxial direction which includes not only the direction of resonator arrangement in the cutoff waveguide but also the width direction of the cutoff waveguide. Hence, the adjustment of the degree of electrical coupling between the coaxial dielectric resonators adjacent to each other on the border at the flexure can be made simply, compared with that in conventional coaxial dielectric filters.

In addition, since the adjacent-side ends of a pair of coaxial dielectric resonators adjacent to each other on the border at the flexure each form the slope which is in parallel or substantially in parallel to a flexure cross section along the line passing the middle or substantially the middle of each of the outer peripheral side and inner peripheral side at the flexure in the cutoff waveguide, the coaxial dielectric resonators have such a relation that their adjacent-side ends face each other on the border at the flexure. Hence, the electrical coupling between the coaxial dielectric resonators may hardly weaken even when the flexure is set at small angles, and the degree of electrical coupling stated above can be made well-balanced.

Figure 11A:
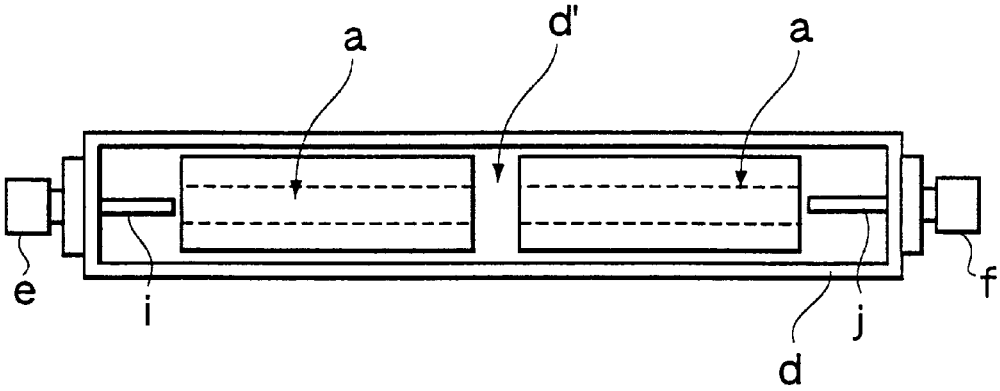
FIG. 11A is a cover-removed plan view of a conventional coaxial dielectric filter not making use of capacitors.
Figure 11B:
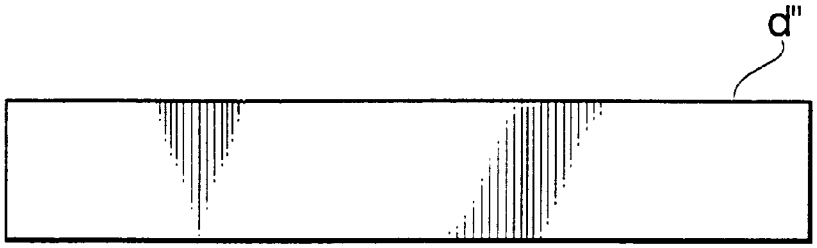
FIG. 11B is a plan view of a metal cover.
Figure 11C:
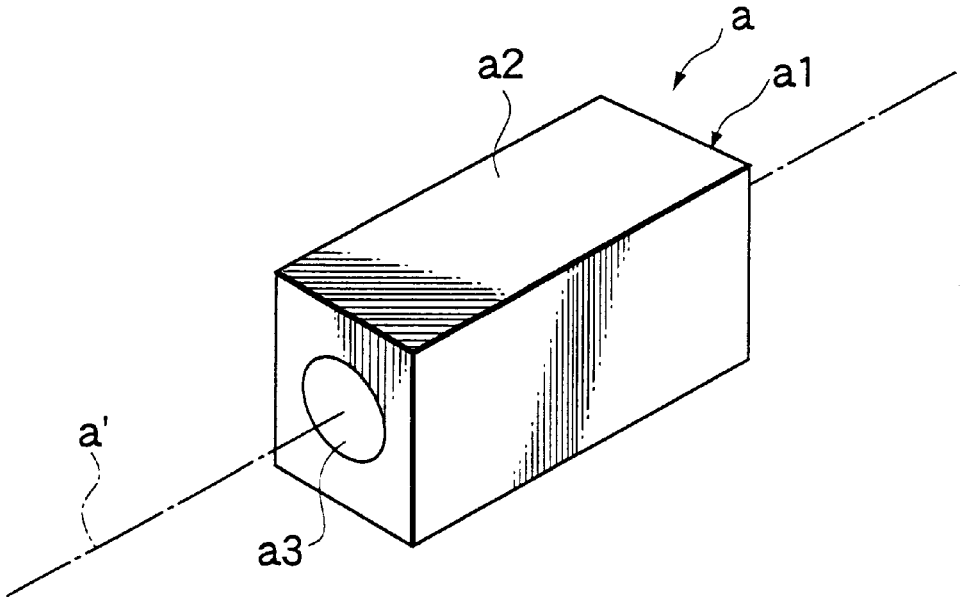
FIG. 11C is a schematic perspective view of a coaxial dielectric resonator mounted on the above coaxial dielectric filter.
Figure 12A:
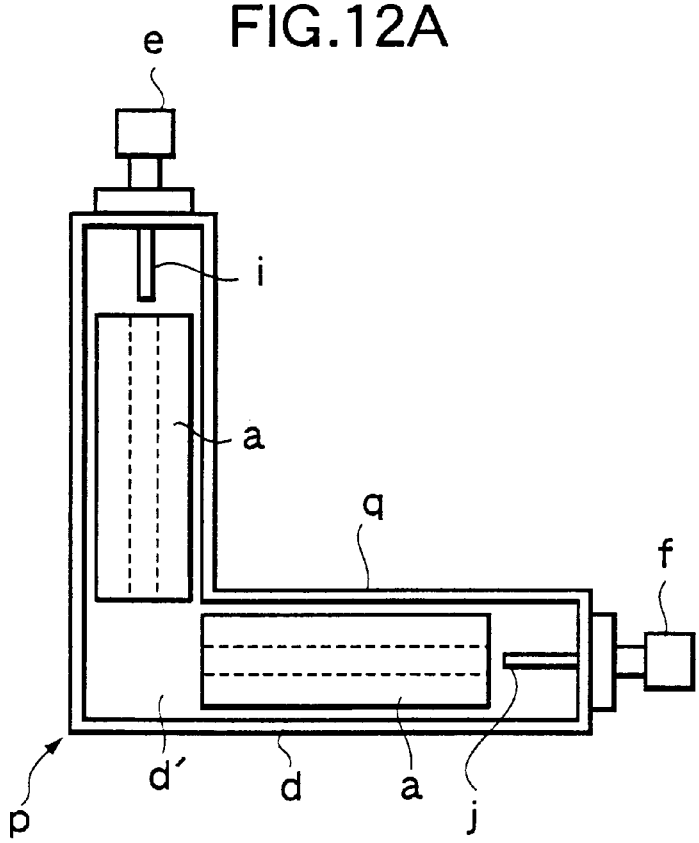
FIG. 12A is a cover-removed plan view of a conventional coaxial dielectric filter having a flexure.
Figure 12B:
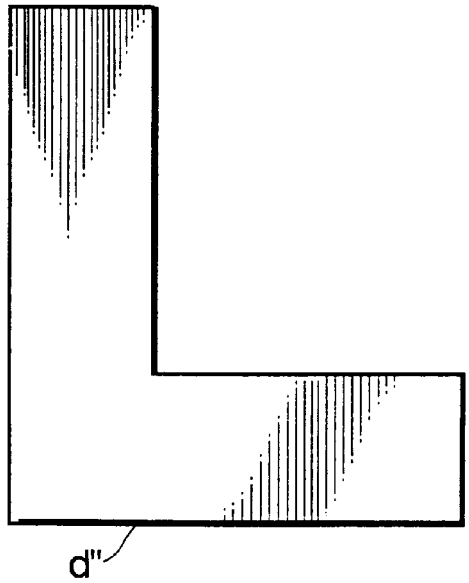
FIG. 12B is a plan view of a metal cover.

In these coaxial dielectric filters, the ends of respective coaxial dielectric resonators that face the leading ends of the input-side and output-side antennas have vertical faces in shape as described previously (see FIG. 11C). Accordingly, in principle, the input and output directions of signals in the conventional coaxial dielectric filter correspond to the direction in which the coaxial dielectric resonators are arranged in the cutoff waveguide, and hence, the freedom of circuit designing in a package where the coaxial dielectric filter of this type is mounted is correspondingly low. In such an instance, it becomes possible to improve the freedom of circuit designing when at least one of the input-side end of the coaxial dielectric resonator disposed on the input side and the output-side end of the coaxial dielectric resonators disposed on the output side is made to have not the vertical surface but a slope.

Figure 3:
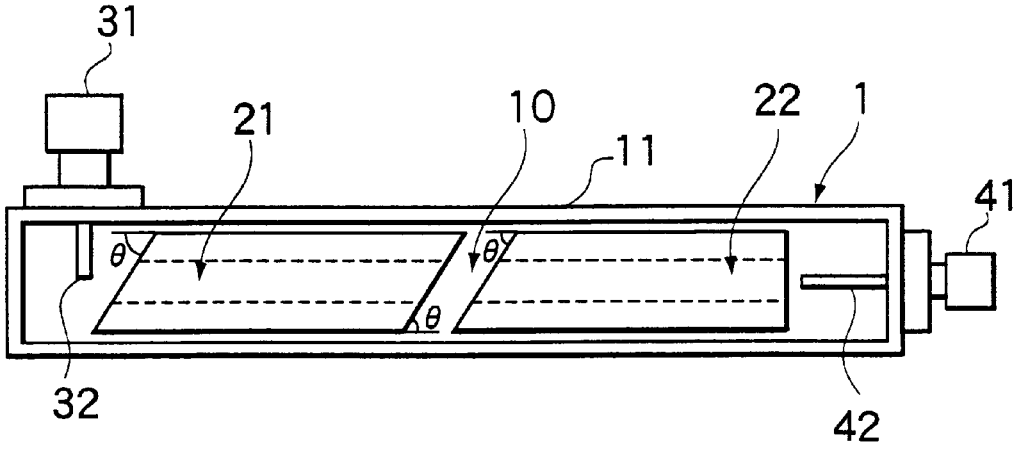
FIG. 3 is a cover-removed plan view of a modification of the coaxial dielectric filter according to the first embodiment of the present invention.
Figure 4:
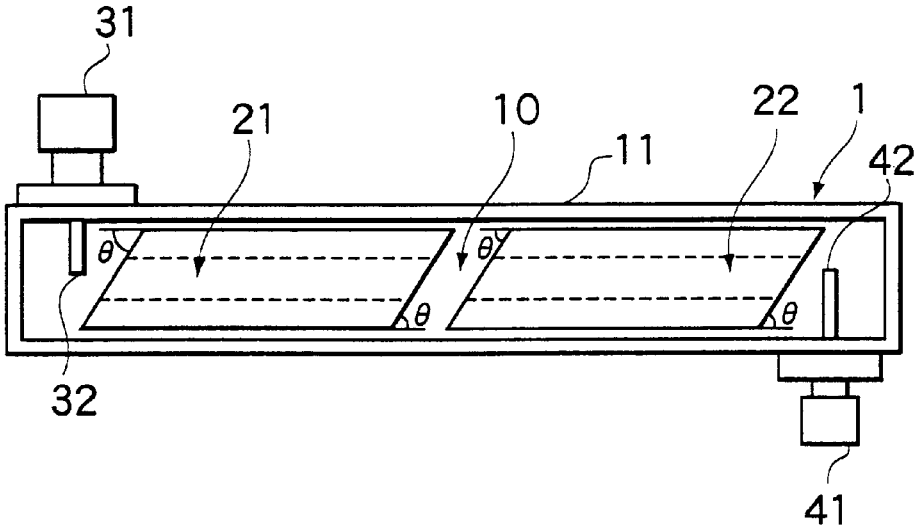
FIG. 4 is a cover-removed plan view of another modification of the coaxial dielectric filter according to the first embodiment of the present invention.
Figure 5:
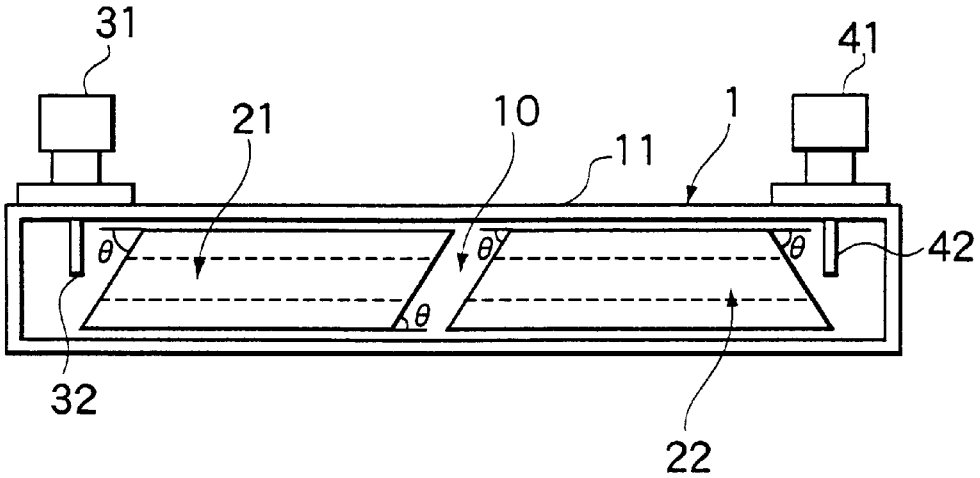
FIG. 5 is a cover-removed plan view of still another modification of the coaxial dielectric filter according to the first embodiment of the present invention.

More specifically, in the coaxial dielectric filter whose cutoff waveguide is of the straight type, the filter may be so set up that at least one of the input-side end of the coaxial dielectric resonator disposed on the input side and the output-side end of the coaxial dielectric resonators disposed on the output side is made to have a slope which is inclined with respect to the cutoff waveguide in its cross section perpendicular to the lengthwise direction of the cutoff waveguide, and also that the input-side and/or output-side antenna(s) is/are, on its/their base end side(s), supported directly or by means of the input-side and/or output-side connector(s) on the wall surface(s) of the cutoff waveguide on its side(s) standing parallel to the lengthwise direction of the cutoff waveguide and facing the slope(s) of the coaxial dielectric resonator(s) disposed on the input side and/or output side thereof (FIGS. 3 to 5). Thus, the coaxial dielectric filter can be made smaller in its size in the lengthwise direction to enable miniaturization of the filter. Also, the leading end(s) of the input-side and/or output-side antenna (s) may be so set as to stand close to substantially the center(s) of the slope(s) of the coaxial dielectric resonator(s) disposed on the input side and/or output side (FIGS. 3 to 5). Thus, the input and output directions of signals in the input-side and output-side antenna can be set arbitrarily, and hence it becomes possible to improve greatly the freedom of circuit designing in the package where the coaxial dielectric filter of this type is mounted.

Figure 7A:
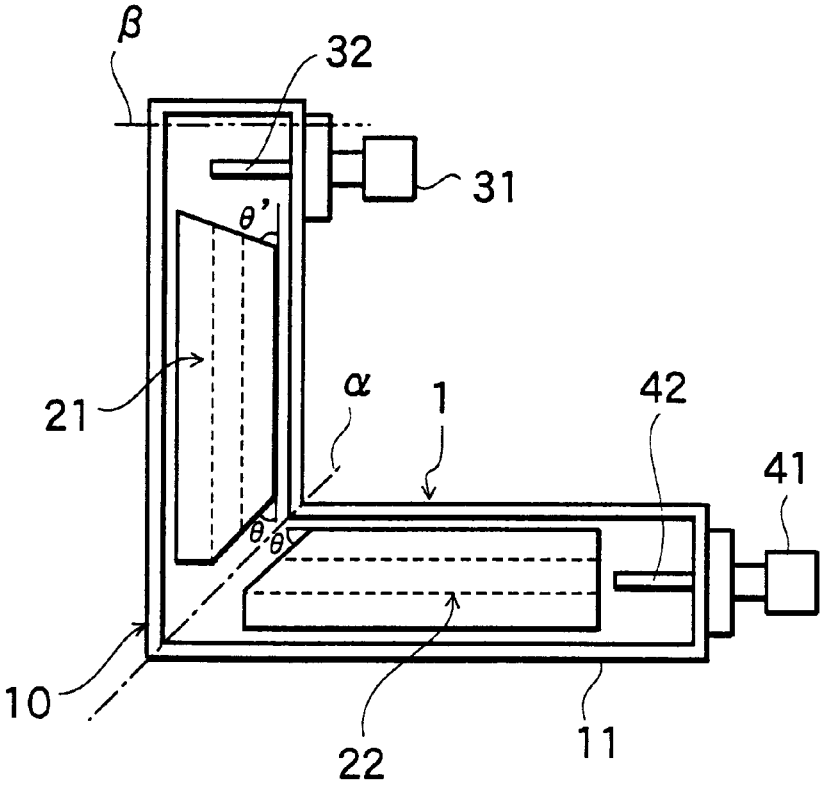
FIG. 7A is a cover-removed plan view of a modification of the coaxial dielectric filter according to the second embodiment of the present invention.

In the coaxial dielectric filter whose cutoff waveguide has a flexure, too, the filter may be so set up that at least one of the input-side end of the coaxial dielectric resonator disposed on the input side and the output-side end of the coaxial dielectric resonators disposed on the output side is made to have a slope which is inclined with respect to a cross section parallel to the width direction of the cutoff waveguide, and also that the input-side and/or output-side antenna(s) is/are, on its(their) base end side(s), supported directly or by means of the input-side and/or output-side connector(s) on the wall surface(s) of the cutoff waveguide on its side(s) standing perpendicular to the width direction of the cutoff waveguide and facing the slope(s) of the coaxial dielectric resonator(s) disposed on the input side and/or output side thereof (FIG. 7A). Thus, the input and output directions of signals in the input-side and output-side antenna can be set arbitrarily, and hence it becomes possible to improve greatly the freedom of circuit designing in the package where the coaxial dielectric filter of this type is mounted.

In the coaxial dielectric filter whose cutoff waveguide has a flexure, the flexure of the cutoff waveguide may be in any number, which is determined appropriately depending on the disposing space in a package in which the coaxial dielectric filters of this type are incorporated and the shape of the space. More specifically, when the cutoff waveguide has one flexure, it has substantially an L-shape. When the cutoff waveguide has two flexures, it has substantially a U-shape or Z-shape (hook-shape). Also, depending on the purpose for which the coaxial dielectric filter is used, the number of the flexure and the flexing direction may be so selected that the cutoff waveguide is constructed curvedly through a three-dimensional space.

As the coaxial dielectric resonators incorporated in the cutoff waveguide in the present invention, those having a high dielectric constant may preferably be used from the viewpoint of miniaturization of the filter. In many cases, however, those having a high dielectric constant are commonly formed of materials having a great loss at high frequencies. Such a loss occurring in the coaxial dielectric resonators leads to a loss occurring in the filter, and hence the materials may preferably be selected taking account well of characteristic values of the intended filter.

Accordingly, the coaxial dielectric resonator used in the present invention may include those constituted chiefly of a tubular main body formed of, e.g., a barium or titanium type oxide ceramic, and conductor layers formed of thick-film silver paste, provided on the periphery and inner wall of the tubular main body (the conductor layer provided on the inner wall is called the inner conductor, and the conductor layer provided on the periphery is called the outer conductor). With regard to the number of the coaxial dielectric resonators incorporated in the cutoff waveguide, it may be any number so long as it is at least two.

In the present invention, as the cutoff waveguide of a straight type or that having a flexure, a waveguide may be used which is constituted chiefly of a waveguide main body having a holding part in which the coaxial dielectric resonators are disposed and a cover material which closes the open side of the holding part. With regard to the waveguide main body, it may be formed by hollowing out a heavy-gauge (block) metal material such as duralumin by cutting, or may be formed by bending a steel sheet having a thickness of about 0.8 mm or a steel sheet surface-coated with silver and having a like thickness. The waveguide main body may also be formed of a casing made of resin, produced by sub-coating nickel on the surface of a plastic material obtained by injection-molding ABS resin, acrylonitrile resin, butadiene resin or styrol resin into the shape of a casing, followed by metal plating such as silver plating to make surface finishing.

The coaxial dielectric filter according to the present invention may be applied to any uses as exemplified by regenerative repeaters of optical communication, and wireless communication equipment.

As described above in detail, according to the coaxial dielectric filter of the present invention whose cutoff waveguide has a straight structure, the adjacent-side end of at least one of the coaxial dielectric resonators adjacent to each other forms the slope which is inclined with respect to the cutoff waveguide in its cross section perpendicular to its lengthwise direction. Hence, as stated previously, in the instance where at least two coaxial dielectric resonators are disposed in the cutoff waveguide and the distance between the coaxial dielectric resonators adjacent to each other is adjusted, the distance between the coaxial dielectric resonators on their adjacent sides can be adjusted not only when the coaxial dielectric resonator provided with the slope is moved in the lengthwise direction of the cutoff waveguide but also when it is moved in the width direction of the cutoff waveguide.

More specifically, since the direction of movement of the coaxial dielectric resonator for the adjustment of the degree of electrical coupling between the coaxial dielectric resonators adjacent to each other can be a biaxial direction which includes not only the lengthwise direction of the cutoff waveguide but also its width direction, the present invention has an advantage that the adjustment of the degree of electrical coupling between the coaxial dielectric resonators adjacent to each other can be made simply, compared with that in conventional coaxial dielectric filters.

In the coaxial dielectric filter of the present invention whose cutoff waveguide has a flexure, too, the adjacent-side ends of a pair of coaxial dielectric resonators adjacent to each other on the border at the flexure each form the slope which is in parallel or substantially in parallel to the flexure cross section. Hence, as stated previously, in the instance where the distance between the pair of coaxial dielectric resonators adjacent to each other on the border at the flexure is adjusted, the distance between the coaxial dielectric resonators on their adjacent sides can be adjusted not only when the coaxial dielectric resonator provided with the slope is moved in the direction of resonator arrangement but also when it is moved in the width direction of the cutoff waveguide.

More specifically, since the direction of movement of the coaxial dielectric resonator for the adjustment of the degree of electrical coupling between the coaxial dielectric resonators adjacent to each other on the border at the flexure can be a biaxial direction which includes not only the direction of resonator arrangement in the cutoff waveguide but also the width direction of the cutoff waveguide, the present invention has another advantage that the adjustment of the degree of electrical coupling between the coaxial dielectric resonators adjacent to each other on the border at the flexure can be made simply, compared with that in conventional coaxial dielectric filters.

Since also the adjacent-side ends of a pair of coaxial dielectric resonators adjacent to each other on the border at the flexure each form the slope which is in parallel or substantially in parallel to a flexure cross section along the line passing the middle or substantially the middle of each of the outer peripheral side and inner peripheral side at the flexure in the cutoff waveguide, the coaxial dielectric resonators have such a relation that their adjacent-side ends face each other on the border at the flexure. Thus, the present invention has still another advantage that the electrical coupling between the coaxial dielectric resonators may hardly weaken even when the flexure is set at small angles, and the degree of electrical coupling stated above can be made well-balanced.

The embodiments of the present invention will be described below in greater detail with reference to the accompanying drawings.

First Embodiment

Figure 1B:
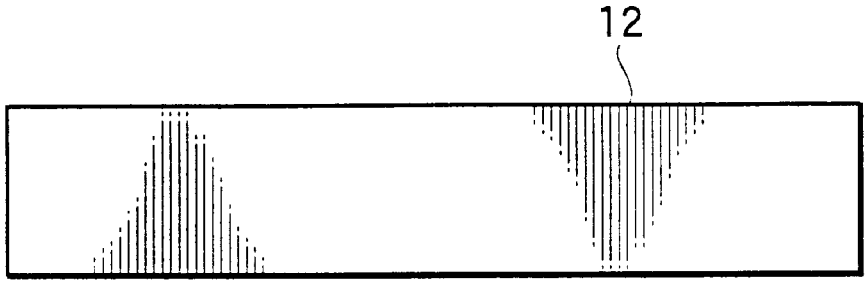
FIG. 1B is a plan view of a metal cover.

The coaxial dielectric filter according to the first embodiment is constituted chiefly of, as shown in FIGS. 1A and 1B, i) a straight cutoff waveguide 1, ii) two coaxial dielectric resonators (½ wavelength type resonators) 21 and 22 disposed coaxially or substantially coaxially and at an interval in the cutoff waveguide 1, iii) an input-side connector 31 fastened to the wall surface on the one-end side in the lengthwise direction of the cutoff waveguide 1, iv) a rod-like input-side antenna 32 whose base end is supported by the input-side connector 31 and whose leading end stands close, or inserted, to the inside of an input-side inner conductor of the coaxial dielectric resonator 21 disposed on the input side, v) an output-side connector 41 fastened to the wall surface on the other-end side in the lengthwise direction of the cutoff waveguide 1, and vi) a rod-like output-side antenna 42 whose base end is supported by the output-side connector 41 and whose leading end stands close, or inserted, to the inside of an output-side inner conductor of the coaxial dielectric resonator 22 disposed on the output side.

First, the cutoff waveguide 1 is, as shown in FIGS. 1A and 1B, constituted of a metal casing 11 made of aluminum which is provided with substantially a rectangular holding part 10, and a metal cover 12 made of aluminum which closes the open side of the metal casing 11. Incidentally, materials constituting the cutoff waveguide 1 are, in addition to aluminum, exemplified by alloys thereof, brass, and gold-plated plastic materials.

The coaxial dielectric resonators 21 and 22 are, as shown in FIG. 1A, each constituted chiefly of i) a tubular main body having a cross-sectionally quadrangular shape in appearance and having a cross-sectionally circular shape at its cavity, formed of a lead titanate type or barium titanate type dielectric material, and ii) silver conductive films provided on the periphery and inner wall of the tubular main body. The adjacent-side ends of these resonators 21 and 22 are each cut obliquely to form a slope which is inclined with respect to the cutoff waveguide 1 in its cross section $\alpha$ perpendicular to the lengthwise direction. Also, each slope is set to have an oblique angle $\theta$ of 60 degrees with respect to the lengthwise direction of the cutoff waveguide 1.

To assemble this coaxial dielectric filter, first the input-side antenna 32 is attached to the metal casing 11 by means of the input-side connector 31, and the input-side coaxial dielectric resonator (½ wavelength type resonator) 21 is disposed in the casing while adjusting its distance to the input-side antenna 32. Then, the coaxial dielectric resonator 21 is fastened to the holding part 10 through an appropriate adhesive.

Next, the output-side coaxial dielectric resonator 22 is arranged adjacently to the coaxial dielectric resonator 21 thus fastened, and the distance between the coaxial dielectric resonators 21 and 22 is adjusted to adjust the degree of electrical coupling between them.

Figure 2A:
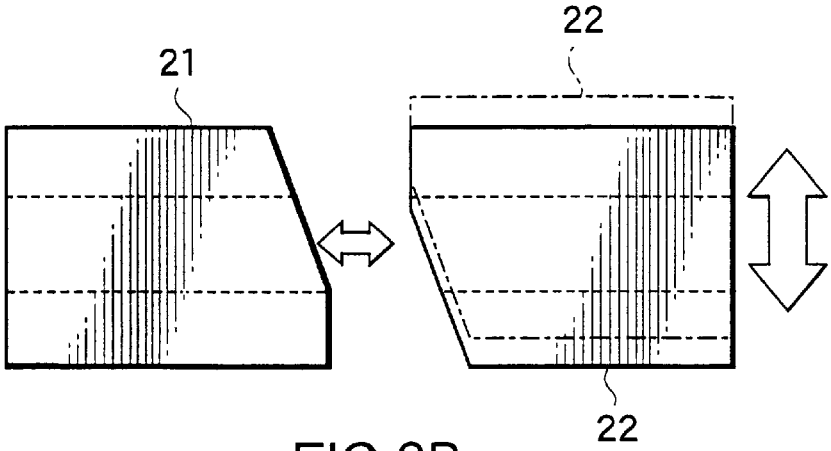
FIG. 2A illustrates how the distance is adjusted between coaxial dielectric resonators in the coaxial dielectric filter according to the first embodiment of the present invention.
Figure 2B:
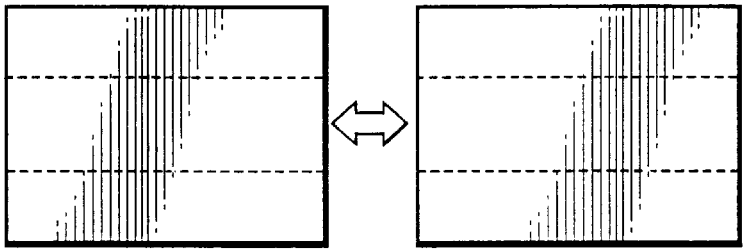
FIG. 2B illustrates how the distance is adjusted between coaxial dielectric resonators in the conventional coaxial dielectric filter, and FIGS. 2C and 2D each illustrate length L of a coaxial dielectric resonator and length δ at its slope in the direction of resonator arrangement.

In this adjustment of distance, the distance between the coaxial dielectric resonators 21 and 22 on their adjacent sides can be adjusted not only when the coaxial dielectric resonator 22 provided with the slope is moved in the lengthwise direction of the cutoff waveguide 1 but also when it is moved in the width direction of the cutoff waveguide 1 (see the illustration by chain lines in FIG. 2A). More specifically, the coaxial dielectric resonator 22 provided with the slope is first moved in the lengthwise direction to adjust its position with respect to the coaxial dielectric resonator 21 having been fastened, and thereafter the coaxial dielectric resonator 22 is next moved in the width direction, thus the distance between the coaxial dielectric resonators 21 and 22 can be micro-adjusted. Hence, compared with conventional coaxial dielectric filters which enable only the adjustment made by moving the resonator in the lengthwise direction as shown in FIG. 2B, the adjustment of the degree of electrical coupling between the coaxial dielectric resonators 21 and 22 can be made simply and also the adjustment precision can be improved.

Figure 2C:
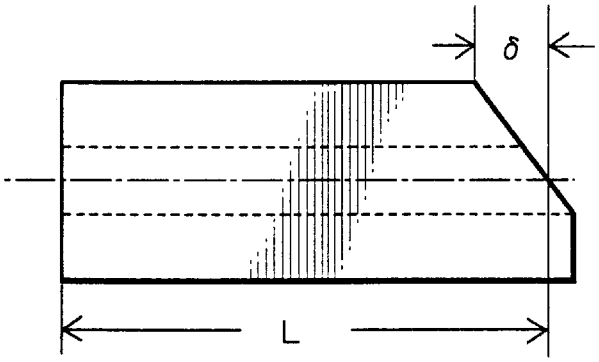
Figure 2D:
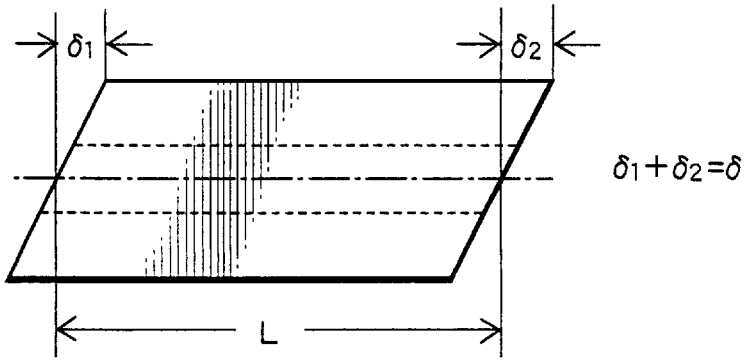

Incidentally, since the coaxial dielectric resonator 22 is moved in the width direction, it may deviate positionally a little in the width direction, with respect to the fastened coaxial dielectric resonator 21 (that is, it follows that the coaxial dielectric resonator 22 is disposed not perfectly coaxially with respect to the coaxial dielectric resonator 21). It, however, has been confirmed that such positional deviation may affect filter characteristics only very slightly. It has also been confirmed that any occurrence of spurious signals ascribable to the feature that the adjacent-side ends of the coaxial dielectric resonators 21 and 22 form slopes may cause almost no problem so long as the following condition is fulfilled. That is, when as shown in FIGS. 2C and 2D the length of a coaxial dielectric resonator is represented by L and the length thereof at its slope in the direction of resonance arrangement by $\delta$(or $\delta=\delta 1+\delta 2$ in the case when slopes are provided on both ends of a coaxial dielectric resonator as shown in FIG. 2D), the occurrence of spurious signals can be prevented so long as the resonator fulfills the condition that $\delta/L$ is less than ⅕.

In this way, the coaxial dielectric resonator 22 is fastened to the holding part 10 of the metal casing 11 through an appropriate adhesive, and also the output-side antenna 42 is cut to have a length suited for the adjustment to the coaxial dielectric resonator 22. Thereafter, the output-side antenna 42 is attached to the metal casing 11 by means of the output-side connector 41, thus the coaxial dielectric filter according to the first embodiment is completed.

In the present embodiment, the two coaxial dielectric resonators 21 and 22 are used. As a modification thereof, three or more coaxial dielectric resonators may be incorporated to make up the coaxial dielectric filter. Also, in the present embodiment, the adjacent-side end of each coaxial dielectric resonator is set to have an oblique angle $\theta$ of 60 degrees. It has been confirmed that the present invention is likewise effective also when the oblique angle $\theta$ is set at 45 degrees or 70 degrees. In some cases, only the adjacent-side end of the coaxial dielectric resonator 22 may be made to form the slope and, as the adjacent-side end of the coaxial dielectric resonator 21, one having a vertical surface as in conventional cases may be used as it is.

FIG. 3 is a plan view of a modification of the coaxial dielectric filter according to the first embodiment of the present invention, in which the input direction of signals is perpendicular or substantially perpendicular to the lengthwise direction of the cutoff waveguide.

More specifically, in this coaxial dielectric filter, the input-side end of a coaxial dielectric resonator 21 is cut obliquely to form a slope which is inclined with respect to a cutoff waveguide 1 in its cross section perpendicular to the lengthwise direction. Also, an input-side antenna 32 is, on its base-end side, supported on the wall surface of the cutoff waveguide 1 on its side standing parallel to the lengthwise direction of the cutoff waveguide 1 and facing the slope of the coaxial dielectric resonator 21 disposed on the input side. The input-side antenna 32 is so supported by means of an input-side connector 31. The leading end of the input-side antenna 32 stands close to substantially the center of the slope of the coaxial dielectric resonator 21. Thus, the input direction of signals in the input-side antenna 32 is perpendicular or substantially perpendicular to the lengthwise direction of the cutoff waveguide 1. Except for this feature, this coaxial dielectric filter is substantially the same as the coaxial dielectric filter shown in FIGS. 1A and 1B. Each slope is set to have an oblique angle $\theta$ of 60 degrees with respect to the lengthwise direction of the cutoff waveguide 1.

Like the coaxial dielectric filter shown in FIGS. 1A and 1B, this coaxial dielectric filter also has the advantage that, compared with conventional coaxial dielectric filters which enable only the adjustment made by moving the resonator in the lengthwise direction, the adjustment of the degree of electrical coupling between the coaxial dielectric resonators 21 and 22 can be made simply and also the adjustment precision can be improved.

Moreover, since this coaxial dielectric filter has the structure wherein the base end of the input-side antenna 32 is supported on the wall surface of the cutoff waveguide on its lengthwise side facing the slope of the coaxial dielectric resonator 21, by means of the input-side connector 31, the size of the coaxial dielectric filter in its lengthwise direction can be made smaller to enable miniaturization. Also, since the input direction of signals is perpendicular or substantially perpendicular to the lengthwise direction of the cutoff waveguide, this filter has the advantage that the freedom of circuit designing in the package where the coaxial dielectric filter of this type is mounted can be improved greatly.

In this modified first embodiment, the adjacent-side ends of the coaxial dielectric resonators 21 and 22 and the input-side end of the coaxial dielectric resonator 21 disposed on the input side are also each set to have an oblique angle $\theta$ of 60 degrees. It has also been confirmed that the present invention is likewise effective also when each oblique angle $\theta$ is set at 45 degrees or 70 degrees.

FIGS. 4 and 5 are plan views of additional modifications of the coaxial dielectric filter according to the first embodiment of the present invention, in which the input direction and output direction of signals are perpendicular or substantially perpendicular to the lengthwise direction of the cutoff waveguide.

More specifically, in the coaxial dielectric filter shown in FIG. 4, the input-side end of a coaxial dielectric resonator 21 and the output-side end of a coaxial dielectric resonator 22 are cut obliquely to form slopes which are inclined with respect to a cutoff waveguide 1 in its cross section perpendicular to the lengthwise direction. Also, an input-side antenna 32 and an output-side antenna 42 are, on their base end sides, supported on the wall surface of the cutoff waveguide 1 on its sides standing parallel to the lengthwise direction of the cutoff waveguide 1 and facing the slopes of the coaxial dielectric resonators 21 and 22 disposed on the input side and output side, respectively. The antennas 32 and 42 are so supported by means of an input-side connector 31 and an input-side connector 41, respectively. The leading ends of the input-side antenna 32 and the output-side antenna 42 stands close to substantially the center of the slopes of the coaxial dielectric resonators 21 and 22, respectively. Thus, the input direction of signals in the input-side antenna 32 and the output direction of signals on the output-side antenna 42 are each perpendicular or substantially perpendicular to the lengthwise direction of the cutoff waveguide 1. Except for this feature, this coaxial dielectric filter is substantially the same as the coaxial dielectric filter shown in FIGS. 1A and 1B. Each slope is set to have an oblique angle δ of 60 degrees with respect to the lengthwise direction of the cutoff waveguide 1.

Like the coaxial dielectric filter shown in FIG. 3, this coaxial dielectric filter also has the advantages that the adjustment of the degree of electrical coupling between the coaxial dielectric resonators 21 and 22 can be made simply and also the freedom of circuit designing in the package where the coaxial dielectric filter of this type is mounted can be improved greatly.

The coaxial dielectric filter shown in FIG. 5 is substantially the same as the coaxial dielectric filter shown in FIG. 4, except that an input-side antenna 32 and an input-side connector 31, and an output-side antenna 42 and an output-side connector 41, are provided on the same-side wall surface of the cutoff waveguide.

Second Embodiment

Figure 6A:
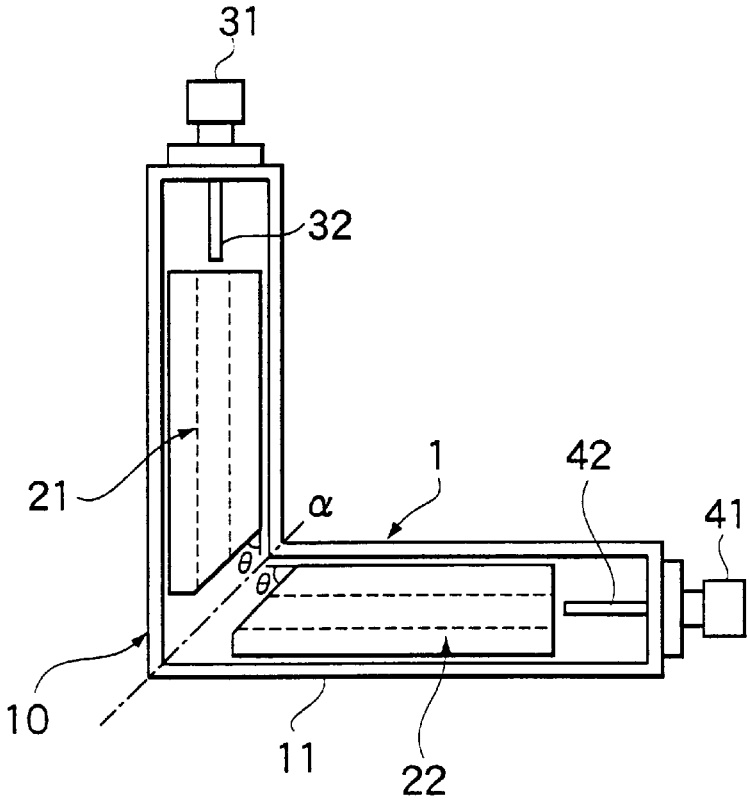
FIG. 6A is a cover-removed plan view of a coaxial dielectric filter according to the second embodiment of the present invention.
Figure 6B:
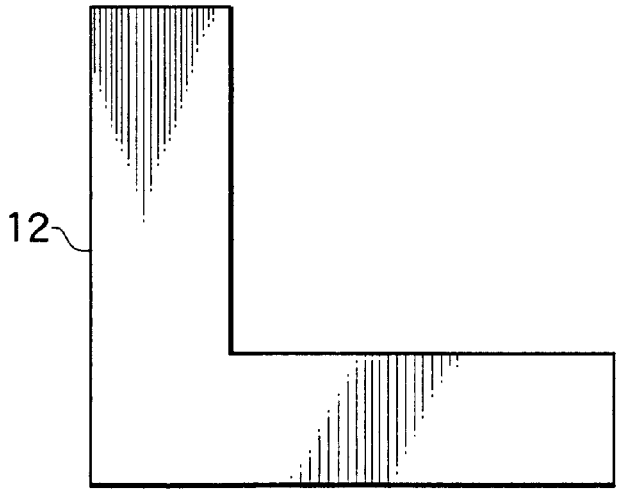
FIG. 6B is a plan view of a metal cover.

The coaxial dielectric filter according to the second embodiment is constituted chiefly of, as shown in FIGS. 6A and 6B, i) a cutoff waveguide 1 having one flexure 10 set at an angle of substantially 90 degrees, ii) two coaxial dielectric resonators (½ wavelength type resonators) 21 and 22 disposed coaxially or substantially coaxially and at an interval in the cutoff waveguide 1 on its both sides bordering at the flexure, iii) an input-side connector 31 fastened to the wall surface on the one-end side in the direction of resonator arrangement in the cutoff waveguide 1, iv) a rod-like input-side antenna 32 whose base end is supported by the input-side connector 31 and whose leading end stands close, or inserted, to the inside of an input-side inner conductor of the coaxial dielectric resonator 21 disposed on the input side, v) an output-side connector 41 fastened to the wall surface on the other-end side in the direction of resonator arrangement in the cutoff waveguide 1, and vi) a rod-like output-side antenna 42 whose base end is supported by the output-side connector 41 and whose leading end stands close, or inserted, to the inside of an output-side inner conductor of the coaxial dielectric resonator 22 disposed on the output side.

First, the cutoff waveguide 1 is, as shown in FIGS. 6A and 6B, constituted of i) a metal casing 11 having substantially a U-shape in its cross section and substantially an L-shape in its plane, obtained by bending sheet-like duralumin, and ii) a metal cover 12 having substantially an L-shape and made of duralumin, which closes the open side of the metal casing 11. Incidentally, materials constituting the cutoff waveguide 1 are, in addition to duralumin, exemplified by brass, and gold-plated plastic materials.

The coaxial dielectric resonators 21 and 22 are, as shown in FIG. 6A, each constituted chiefly of i) a tubular main body having a cross-sectionally quadrangular shape in appearance and having a cross-sectionally circular shape at its cavity, formed of a lead titanate type or barium titanate type dielectric material, and ii) silver conductive films provided on the periphery and inner wall of the tubular main body. The adjacent-side ends of these resonators 21 and 22 are each cut obliquely to form a slope which is in parallel or substantially in parallel to a flexure cross section α along the line passing the middle or substantially the middle of each of the outer peripheral side and inner peripheral side at the flexure 10 in the cutoff waveguide. Also, each slope is set to have an oblique angle θ of 45 degrees with respect to the direction of resonator arrangement in the cutoff waveguide 1.

To assemble this coaxial dielectric filter, first the input-side antenna 32 is attached to the metal casing 11 by means of the input-side connector 31, and the input-side coaxial dielectric resonator (½ wavelength type resonator) 21 is disposed in the casing on its input side bordered by the flexure 10 while adjusting its distance to the input-side antenna 32. Then, the coaxial dielectric resonator 21 is fastened to the interior of the metal casing 11 through an appropriate adhesive.

Next, the coaxial dielectric resonator 22 is arranged adjacently to the coaxial dielectric resonator 21 thus fastened and on the output side bordered by the flexure 10, and the distance between the coaxial dielectric resonators 21 and 22 is adjusted to adjust the degree of electrical coupling between them.

In this adjustment of distance, the distance between the coaxial dielectric resonators 21 and 22 on their adjacent sides can be adjusted not only when the coaxial dielectric resonator 22 provided with the slope is moved in the direction of resonator arrangement but also when it is moved in the width direction of the cutoff waveguide 1 (see the illustration by chain lines in FIG. 2A). More specifically, the coaxial dielectric resonator 22 provided with the slope is first moved in the direction of resonator arrangement to adjust its position with respect to the coaxial dielectric resonator 21 having been fastened, and thereafter the coaxial dielectric resonator 22 is next moved in the width direction, thus the distance between the coaxial dielectric resonators 21 and 22 can be micro-adjusted. Hence, compared with conventional coaxial dielectric filters which enable only the adjustment made by moving the resonator in the direction of resonator arrangement as shown in FIG. 2B, the adjustment of the degree of electrical coupling between the coaxial dielectric resonators 21 and 22 can be made simply and also the adjustment precision can be improved.

In this way, the coaxial dielectric resonator 22 is fastened to the interior of the metal casing 11 through an appropriate adhesive, and also the output-side antenna 42 is cut to have a length suited for the adjustment to the coaxial dielectric resonator 22. Thereafter, the output-side antenna 42 is attached to the metal casing 11 by means of the output-side connector 41, thus the coaxial dielectric filter according to the second embodiment is completed.

In addition to the advantage that the adjustment of the degree of electrical coupling between the coaxial dielectric resonators 21 and 22 can be made simply in the manufacture of filters, this coaxial dielectric filter has the following advantage: Since the adjacent-side ends of these resonators 21 and 22 are each cut obliquely to form the slope which is in parallel or substantially in parallel to a flexure cross section α along the line passing the middle or substantially the middle of each of the outer peripheral side and inner peripheral side at the flexure 10 of the cutoff waveguide, the coaxial dielectric resonators 21 and 22 have such a relation that their adjacent-side ends face each other through the flexure cross section α. Hence, the electrical coupling between the coaxial dielectric resonators 21 and 22 may hardly weaken even when the flexure is set at a small angle of 90 degrees. Thus, the degree of electrical coupling can be made well-balanced at three points, i.e., between the coaxial dielectric resonator 21 disposed on the input side and the input-side antenna 32, between the coaxial dielectric resonator 22 disposed on the output side and the output-side antenna 42 and between the two coaxial dielectric resonators 21 and 22, making it possible to make the coaxial dielectric filter of this type have the desired characteristics.

Moreover, since in this coaxial dielectric filter the cutoff waveguide 1 having the flexure 10 is used, the length itself of the filter can be made smaller. Accordingly, when such a filter is mounted on a device in the state it is integrated in a package together with electronic circuits, the device can be made to have no dead space by disposing component parts such as electronic circuits at the space on the inner peripheral side at the flexure 10 of the cutoff waveguide 1, making it possible to achieve great miniaturization.

In the present embodiment, the two coaxial dielectric resonators 21 and 22 are used. As a modification thereof, three or more coaxial dielectric resonators may be incorporated to make up the coaxial dielectric filter. Also, in the present embodiment, the adjacent-side end of each coaxial dielectric resonator is set to have an oblique angle θ of 45 degrees correspondingly to the flexure 10 set at an angle of substantially 90 degrees (i.e., the oblique angle θ is set at 45 degrees so as to form the slope which is in parallel or substantially in parallel to the flexure cross section α along the line passing the middle or substantially the middle of each of the outer peripheral side and inner peripheral side at the flexure 10). As a modification thereof, the oblique angle θ may be so set at any angle as to provide a slope which is in parallel or substantially in parallel to the flexure cross section α correspondingly to the angle at which the flexure 10 is provided.

Figure 7B:
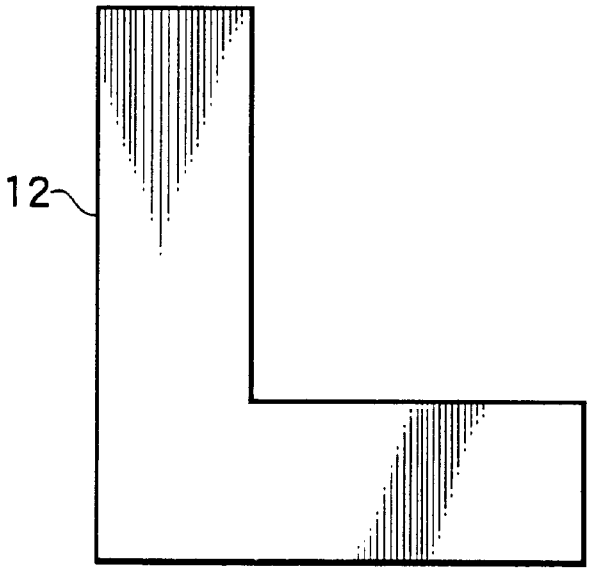
FIG. 7B is a plan view of a metal cover.

FIGS. 7A and 7B are plan views of a modification of the coaxial dielectric filter according to the second embodiment of the present invention, in which the input direction of signals is in parallel or substantially in parallel to the width direction of the cutoff waveguide 1.

More specifically, in this coaxial dielectric filter, the input-side end of a coaxial dielectric resonator 21 is cut obliquely to form a slope which is inclined with respect to a cutoff waveguide 1 in its cross section β parallel to the width direction of the cutoff waveguide 1. Also, an input-side antenna 32 is, on its base-end side, supported on the wall surface of the cutoff waveguide 1 on its side standing perpendicular to the width direction of the cutoff waveguide 1 and facing the slope of the coaxial dielectric resonator 21 disposed on the input side. The input-side antenna 32 is so supported by means of an input-side connector 31. The leading end of the input-side antenna 32 stands close to substantially the center of the slope of the coaxial dielectric resonator 21. Thus, the input direction of signals in the input-side antenna 32 is in parallel or substantially in parallel to the width direction of the cutoff waveguide 1. Except for this feature, this coaxial dielectric filter is substantially the same as the coaxial dielectric filter shown in FIGS. 6A and 6B. The above slope, having an inclination, is set to have an oblique angle θ' of 60 degrees with respect to the direction of resonator arrangement.

Like the coaxial dielectric filter shown in FIGS. 6A and 6B, this coaxial dielectric filter also has the advantage that, compared with conventional coaxial dielectric filters which enable only the adjustment made by moving the resonator in the direction of resonator arrangement, the adjustment of the degree of electrical coupling between the coaxial dielectric resonators 21 and 22 can be made simply and also the electrical coupling between the coaxial dielectric resonators 21 and 22 may hardly weaken even when the flexure 10 is set at a small angle of 90 degrees. Thus, it becomes possible to make the coaxial dielectric filter have the desired characteristics.

Since also this coaxial dielectric filter has the structure wherein the base end of the input-side antenna 32 is supported on the wall surface of the cutoff waveguide on its lengthwise side facing the slope of the coaxial dielectric resonator 21, by means of the input-side connector 31, the size of the coaxial dielectric filter in its direction of resonator arrangement can be made smaller to enable further miniaturization. Also, since the input direction of signals is in parallel or substantially in parallel to the width direction of the cutoff waveguide, this filter has the advantage that the freedom of circuit designing in the package where the coaxial dielectric filter of this type is mounted can be improved greatly.

In this modified second embodiment, the above slope, having an inclination, is set to have an oblique angle θ' of 60 degrees. It has also been confirmed that the present invention is likewise effective also when the oblique angle θ' is set at 45 degrees or 70 degrees.

Figure 8A:
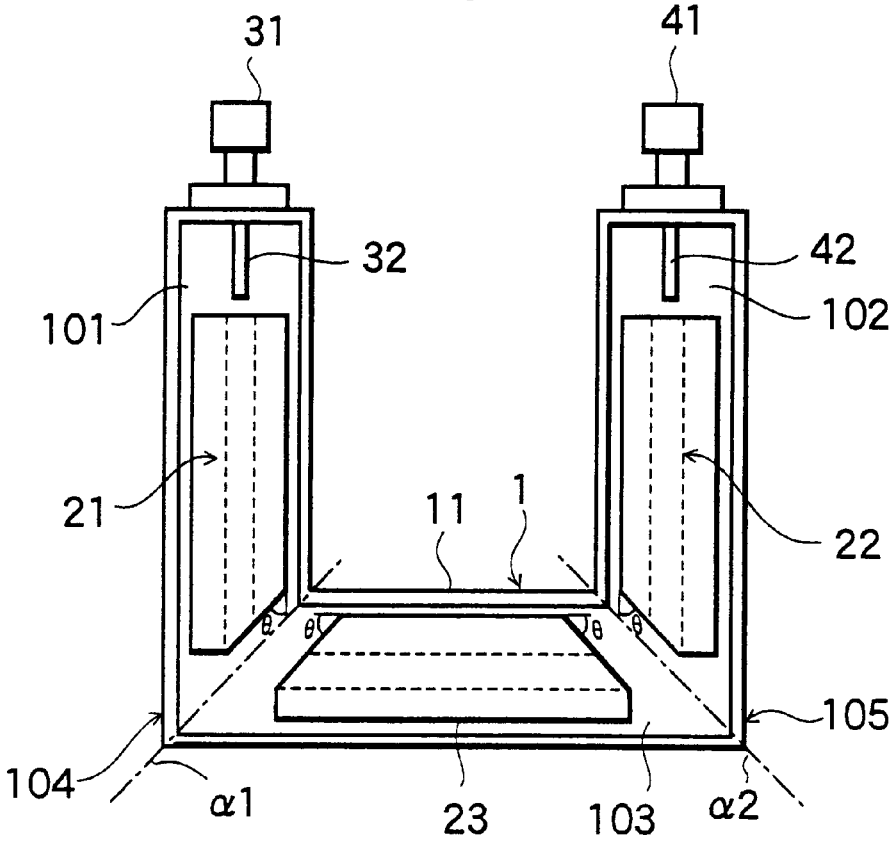
FIG. 8A is a cover-removed plan view of another modification of the coaxial dielectric filter according to the second embodiment of the present invention.
Figure 8B:
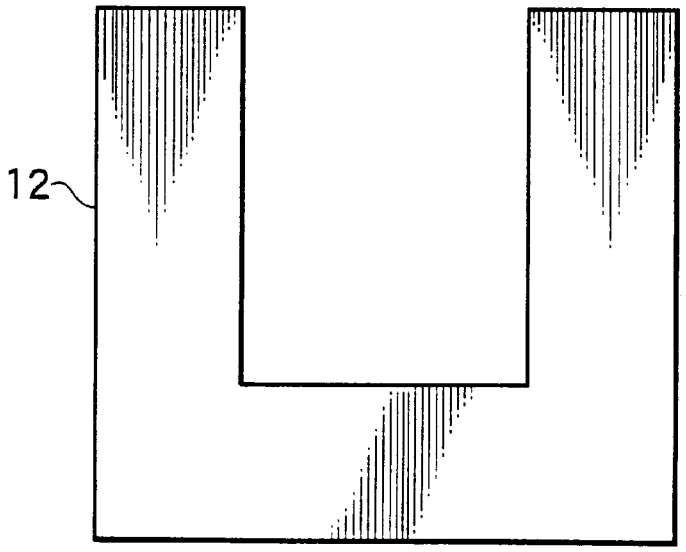
FIG. 8B is a plan view of a metal cover.
Figure 9:
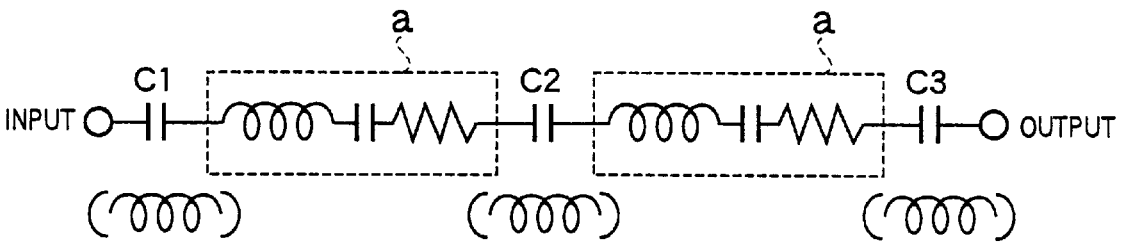
FIG. 9 is an equivalent circuit diagram of a typical dielectric filter making use of coaxial dielectric resonators.
Figure 10:
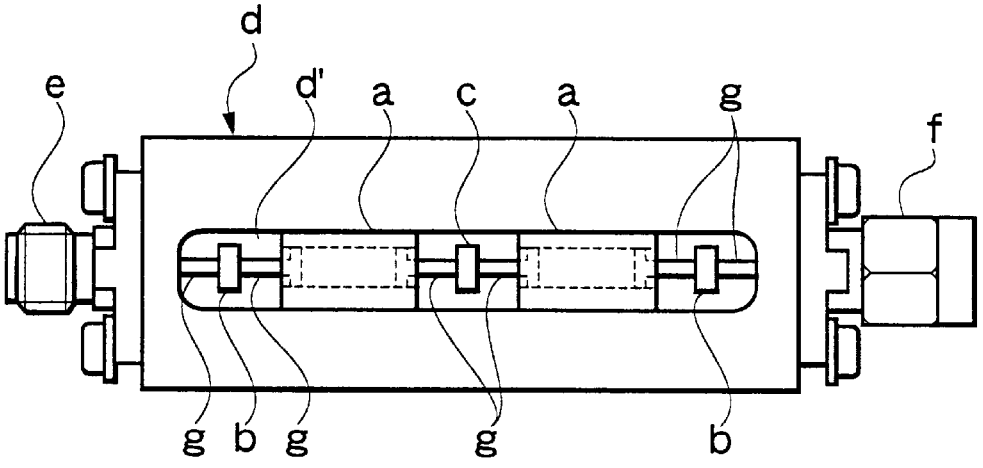
FIG. 10 is a cover-removed plan view of a dielectric filter, in particular, a conventional coaxial dielectric filter making use of capacitors.

FIGS. 8A and 8B illustrate a coaxial dielectric filter in which a substantially U-shaped waveguide having two flexures is used and also one coaxial dielectric resonator is disposed in each of an input-side section and an output-side section which stand parallel to each other and an intermediate section connecting these input-side and output-side sections at their one-side ends.

More specifically, this coaxial dielectric filter is constituted chiefly of i) a cutoff waveguide 1 having substantially a U-shape in its plane, comprising an input-side section 101 and an output-side section 102 which stand parallel to each other and an intermediate section 103 connecting these input-side and output-side sections at their one-side ends, and having two flexures comprising a first flexure 104 having an angle of substantially 90 degrees, formed by the input-side section 101 and the intermediate section 103, and a second flexure 105 having an angle of substantially 90 degrees, formed by the output-side section 102 and the intermediate section 103, ii) one coaxial dielectric resonator (½ wavelength type resonator) 21 disposed in the input-side section 101 of the cutoff waveguide 1, iii) one coaxial dielectric resonator (½ wavelength type resonator) 22 disposed in the output-side section 102 of the cutoff waveguide 1, iv) one coaxial dielectric resonator (½ wavelength type resonator) 23 disposed in the intermediate section 103 of the cutoff waveguide 1, v) an input-side connector 31 fastened to the wall surface on the end side of the input-side section 101 of the cutoff waveguide 1, vi) a rod-like input-side antenna 32 whose base end is supported by the input-side connector 31 and whose leading end stands close, or inserted, to the inside of an input-side inner conductor of the coaxial dielectric resonator 21 disposed on the input side, vii) an output-side connector 41 fastened to the wall surface on the end side of the output-side section 102 of the cutoff waveguide 1, and vi) a rod-like output-side antenna 42 whose base end is supported by the output-side connector 41 and whose leading end stands close, or inserted, to the inside of an output-side inner conductor of the coaxial dielectric resonator 22 disposed on the output side.

First, the cutoff waveguide 1 is, as shown in FIGS. 8A and 8B, constituted of a metal casing 11 made of aluminum which is provided with substantially a U-shaped holding part (constituted of the input-side section 101, the output-side section 102 and the intermediate section 103), and a metal cover 12 made of aluminum which closes the open side of the metal casing 11.

The coaxial dielectric resonators 21, 22 and 23 are, as shown in FIG. 8A, each constituted chiefly of i) a tubular main body having a cross-sectionally quadrangular shape in appearance and having a cross-sectionally circular shape at its cavity, and ii) conductor layers formed of thick-film silver paste, provided on the periphery and inner wall of the tubular main body. The adjacent-side ends of the coaxial dielectric resonators 21 and 23 are each cut obliquely to form a slope which is in parallel or substantially in parallel to a first-flexure cross section $\alpha 1$ along the line passing the middle or substantially the middle of each of the outer peripheral side and inner peripheral side at the first flexure 104 in the cutoff waveguide. Meanwhile, the adjacent-side ends of the coaxial dielectric resonators 23 and 22 are each cut obliquely to form a slope which is in parallel or substantially in parallel to a second-flexure cross section $\alpha 2$ along the line passing the middle or substantially the middle of each of the outer peripheral side and inner peripheral side at the second flexure 105 in the cutoff waveguide. Also, each slope is set to have an oblique angle $\theta$ of 45 degrees with respect to the direction of resonator arrangement in the cutoff waveguide 1.

Like the coaxial dielectric filter shown in FIGS. 6A and 6B, this coaxial dielectric filter also has the advantage that, compared with conventional coaxial dielectric filters which enable only the adjustment made by moving the resonator in the direction of resonator arrangement, the adjustment of the degree of electrical coupling between the coaxial dielectric resonators 21, 22 and 23 can be made simply and also the electrical coupling between the coaxial dielectric resonators 21, 22 and 23 may hardly weaken even when the first flexure 104 and second flexure 105 are set at small angles of 90 degrees. Thus, it becomes possible to make the coaxial dielectric filter have the desired characteristics.

Since also in this coaxial dielectric filter the cutoff waveguide 1 is constituted of the substantially U-shaped waveguide 1 comprising the input-side and output-side sections 101 and 102 standing parallel to each other and one intermediate section 103 connecting these input-side and output-side sections at their one-side ends, the disposing space can be made small greatly. Also, the coaxial dielectric resonators 21 and 22 in the input-side and output-side sections 101 and 102, respectively, have a positional relation parallel to each other, and the input side and output side can be disposed on the same side. Hence, the freedom of circuit designing in the package where the coaxial dielectric filter of this type is mounted can be improved greatly.

What is claimed is:

1. A coaxial dielectric filter comprising;

a straight cutoff waveguide;

at least two coaxial dielectric resonators disposed coaxially or substantially coaxially and at an interval in the cutoff waveguide in its lengthwise direction;

a rod-like input-side antenna whose leading end stands close, or inserted, to the inside of an input-side inner conductor of the coaxial dielectric resonator disposed on the input side; and a rod-like output-side antenna whose leading end stands close, or inserted, to the inside of an output-side inner conductor of the coaxial dielectric resonator disposed on the output side;

wherein;

an adjacent-side end of at least one of coaxial dielectric resonators adjacent to each other forms a slope which is inclined with respect to the cutoff waveguide in its cross section perpendicular to its lengthwise direction.

2. The coaxial dielectric filter according to claim 1, wherein;

at least one of the input-side end of the coaxial dielectric resonator disposed on the input side and the output-side end of the coaxial dielectric resonators disposed on the output side is made to have the slope which is inclined with respect to the cutoff waveguide in its cross section perpendicular to its lengthwise direction;

the input-side and/or output-side antenna(s) is/are, on its/their base end side(s), supported directly or by means of the input-side and/or output-side connector(s) on the wall surface(s) of the cutoff waveguide on its side(s) standing parallel to the lengthwise direction of the cutoff waveguide and facing the slope(s) of the coaxial dielectric resonator(s) disposed on the input side and/or output side thereof; and the leading end(s) of the input-side and/or output-side antenna(s) is/are so set as to stand close to substantially the center(s) of the slope(s) of the coaxial dielectric resonator(s) disposed on the input side and/or output side so that the input direction and/or output direction of signals is/are perpendicular or substantially perpendicular to the lengthwise direction of the cutoff waveguide.

3. A coaxial dielectric filter comprising;

a cutoff waveguide having at least one flexure;

at least two coaxial dielectric resonators disposed coaxially or substantially coaxially and at an interval in the cutoff waveguide on its both sides bordering at the flexure;

a rod-like input-side antenna whose leading end stands close, or inserted, to the inside of an input-side inner conductor of the coaxial dielectric resonator disposed on the input side; and a rod-like output-side antenna whose leading end stands close, or inserted, to the inside of an output-side inner conductor of the coaxial dielectric resonator disposed on the output side;

wherein;

adjacent-side ends of a pair of coaxial dielectric resonators adjacent to each other on the border at the flexure each form a slope which is in parallel or substantially in parallel to a flexure cross section along the line passing the middle or substantially the middle of each of the outer peripheral side and inner peripheral side at the flexure in the cutoff waveguide.

4. The coaxial dielectric filter according to claim 3, wherein;

at least one of the input-side end of the coaxial dielectric resonator disposed on the input side and the output-side end of the coaxial dielectric resonators disposed on the output side is made to have the slope which is inclined with respect to the cutoff waveguide in its cross section parallel to the width direction of the cutoff waveguide;

the input-side and/or output-side antenna(s) is/are, on its/their base end side(s), supported directly or by means of the input-side and/or output-side connector(s) on the wall surface(s) of the cutoff waveguide on its side(s) standing perpendicular to the width direction of the cutoff waveguide and facing the slope(s) of the coaxial dielectric resonator(s) disposed on the input side and/or output side thereof; and the leading end(s) of the input-side and/or output-side antenna(s) is/are so set as to stand close to substantially the center(s) of the slope(s) of the coaxial dielectric resonator(s) disposed on the input side and/or output side so that the input direction and/or output direction of signals is/are parallel or substantially parallel to the width direction of the cutoff waveguide.

5. The coaxial dielectric filter according to claim 3, wherein;

said cutoff waveguide is constituted of a substantially U-shaped waveguide comprising an input-side section and an output-side section which stand parallel to each other and an intermediate section connecting these input-side and output-side sections at their one-side ends;

one coaxial dielectric resonator is disposed in each of the input-side section, output-side section and intermediate section of the substantially U-shaped waveguide;

the adjacent-side ends of the coaxial dielectric resonator disposed in the input-side section and of the coaxial dielectric resonator disposed in the intermediate section each form a slope which is in parallel or substantially in parallel to a first-flexure cross section along the line passing the middle or substantially the middle of each of the outer peripheral side and inner peripheral side at a first flexure in the cutoff waveguide; and the adjacent-side ends of the coaxial dielectric resonator disposed in the intermediate section and of the coaxial dielectric resonator disposed in the output-side section each form a slope which is in parallel or substantially in parallel to a second-flexure cross section along the line passing the middle or substantially the middle of each of the outer peripheral side and inner peripheral side at a second flexure in the cutoff waveguide.

6. The coaxial dielectric filter according to any one of claims 1 to 5, wherein;

said coaxial dielectric resonator is a ½ wavelength type coaxial dielectric resonator comprising a tubular main body provided with an outer conductor and an inner conductor on its periphery and inner wall, respectively.

* * * * *